US012654910B2

(12) United States Patent
Harrison

(10) Patent No.: US 12,654,910 B2
(45) Date of Patent: Jun. 16, 2026

(54) BOTTLE AND CAP SYSTEM

(71) Applicant: Value Smart Products, Inc., Suwanee, GA (US)

(72) Inventor: J. Drew Harrison, Suwanee, GA (US)

(73) Assignee: Value Smart Products, Inc., Suwanee, GA (US)

( * ) Notice: Subject to any disclaimer, the term of this patent is extended or adjusted under 35 U.S.C. 154(b) by 0 days.

(21) Appl. No.: 19/396,888

(22) Filed: Nov. 21, 2025

(65) Prior Publication Data

US 2026/0145847 A1 May 28, 2026

Related U.S. Application Data

(60) Provisional application No. 63/725,727, filed on Nov. 27, 2024.

(51) Int. Cl.
*B65D 41/04* (2006.01)
*B65D 1/02* (2006.01)

(52) U.S. Cl.
CPC ..... *B65D 41/04* (2013.01); *B65D 1/0246* (2013.01)

(58) Field of Classification Search
CPC .. B65D 41/04; B65D 1/0246; B65D 51/1688; B65D 51/1661; B65D 47/32; B65D 90/34
See application file for complete search history.

(56) References Cited

U.S. PATENT DOCUMENTS

| | | | | |
|---|---|---|---|---|
| 4,427,126 | A * | 1/1984 | Ostrowsky | B65D 41/045 220/366.1 |
| 5,785,195 | A * | 7/1998 | Zwemer | B65D 41/04 215/349 |
| 6,889,857 | B2 * | 5/2005 | Francois | B65D 41/0421 215/232 |
| 8,251,236 | B1 * | 8/2012 | Robinson | B65D 51/18 215/276 |
| 2011/0000915 | A1 * | 1/2011 | Kamath | B65D 41/0471 220/315 |
| 2022/0234790 | A1 * | 7/2022 | Falzoni | B65D 41/3428 |

* cited by examiner

*Primary Examiner* — Shawn M Braden
(74) *Attorney, Agent, or Firm* — Sisson & Banyas, Attorneys at Law LLC; Edwin A. Sisson

(57) ABSTRACT

A bottle and cap system includes a bottle and a bottle cap. When the bottle cap is threadably engaged with the bottle a user may squeeze the bottle to release aroma from the contents of the bottle. This is accomplished by vapor voids between the bottle open end and the cap inner lip, and thread channels in the external thread of the bottle. Such vapor voids are formed when the bottle open end contacts a plurality of lip extensions on the inner lip, which extend toward the cap open end, at a plurality of contact points, when the cap is fully threadably engaged with the bottle.

2 Claims, 8 Drawing Sheets

BOTTLE AND CAP SYSTEM

CROSS REFERENCES AND PRIORITIES

This application claims priority from U.S. Provisional Application No. 63/725,727 filed on 27 Nov. 2024, the teachings of which are incorporated by reference herein in their entirety.

BACKGROUND

Bottles, caps, and systems comprising bottles and caps are well-known. That bottle and cap systems are generally arranged to contain the contents of a bottle when the corresponding cap is engaged, and dispense those contents when the cap is removed, is also well known. Additionally, systems comprising bottles and caps configured to dispense or release certain bottle contents while the cap is still engaged are also well known.

Many bottle and cap systems are comprised, at least in part, of flexible materials so that a user may squeeze or otherwise deform either the bottle or the cap to cause certain bottle contents to dispense or release from the system while the cap is engaged with the bottle.

One such type of bottle and cap system is designed to contain contents which are both solid and aromatic simultaneously. At least one of the bottle or cap in such a system may be squeezed or otherwise deformed to release some amount of aroma from the contents of the bottle via the cap while preventing the dispensing of the solid contents of the bottle. Such a system and interaction therewith allows a user to detect the aroma of the contents of the bottle without disengaging the cap from the bottle or dispensing the solid contents of the bottle. The user may also disengage the cap from the bottle to dispense or release the solid contents of the bottle.

Bottle and cap systems which are designed to allow a user to squeeze either the bottle or cap to detect bottle content aroma while the cap is engaged are known to release too little aroma to allow the user to fully detect or appreciate the aroma of the contents. This prevents, for example, a potential consumer from making an informed decision regarding the aroma of the solid contents of the bottle before making a purchase thereof.

The need exists, therefore, for an improved bottle and cap system for allowing a user to interact with the system by squeezing or otherwise deforming at least one of the bottle or cap to release the aroma of the bottle contents while the cap is engaged, without dispensing or releasing the solid contents of the bottle, but to detect a sufficient amount of aroma to make an informed purchasing decision regarding the aroma of the contents. After such purchase the user may disengage the cap to dispense or release the solid contents.

SUMMARY

This specification describes a bottle and cap system. The system typically comprises a bottle cap and a bottle. In some embodiments the bottle and cap system disclosed herein may be made of a plastic or plastics.

The disclosed bottle cap typically comprises an inner lip, which may further comprisea a plurality of lip extensions that extend toward the open end of the bottle cap.

The disclosed bottle typically comprises a bottle open end and at least one external thread, which may further comprise a plurality of thread channels.

The specification discloses that the bottle cap may threadably engage the external thread of the bottle such that the plurality of lip extensions contacts the bottle open end at a plurality of contact points. When the bottle cap is fully threadably engaged with the at least one external thread, the inner lip typically does not contact the bottle open end. This lack of contact creates a plurality of vapor voids.

The specification further discloses that the bottle cap typically comprises a top region, a cap side region, a cap open end, a cap inner face, an inner lip which has an inner lip face, and a plurality of lip extensions that extend from the inner lip face toward the cap open end. The lip extensions may have a lip extension thickness that is greater than 1 mm.

The disclosed inner lip is typically located inside the bottle cap at a lip distance from the cap open end. The inside diameter of the inner lip is typically less than the inside diameter of the cap inner face at the lip distance, and the inner lip is typically about parallel with the cap open end.

In some embodiments, the plurality of lip extensions disclosed herein may comprise at least three (3) lip extensions.

In certain embodiments the circumference of the disclosed inner lip may be discontinuous.

The specification discloses that in some embodiments the cap inner face may comprise at least one internal thread which may make at least one revolution along the cap inner face. In other embodiments the disclosed cap inner face may comprise a plurality of lugs or protrusions extending substantially inward from the cap inner face. In still other embodiments the cap inner face disclosed herein may comprise a cap skirt which is substantially perpendicular to the cap closed end.

In certain embodiments the disclosed bottle cap may comprise a cap closed end which may be substantially parallel with the cap open end. In other embodiments it is disclosed that the circumference of the cap open end may be greater than the circumference of the cap closed end. In some embodiments the bottle cap disclosed herein may be made of a plastic.

The specification also discloses that the bottle typically comprises a bottle open end, a neck region, an upper shoulder region, a bottle side region, and a bottom region. The neck region may comprise at least one external thread which has at least one thread channel, where the thread channel(s) is typically oriented substantially vertically, and substantially perpendicularly to the bottle open end.

In certain embodiments the bottle disclosed herein may be made of a plastic.

DETAILED DESCRIPTION

Described herein is a bottle and cap system. Reference is made to the Figures in which, unless otherwise noted, like numbers refer to like structures. As described herein and in the claims, the following numbers refer to the following structures as noted in the Figures.

100 refers to a bottle cap.
110 refers to a top region.
120 refers to a cap side region.
200 refers to an inner lip.
210 refers to an inner lip face.
220 refers to a plurality of lip extensions.
230 refers to a lip extension thickness.
240 refers to a lip distance.
300 refers to a cap inner face.
310 refers to an internal thread.
400 refers to a cap open end.
410 refers to a cap skirt.
500 refers to a cap closed end.
600 refers to a bottle.
610 refers to a bottle open end.
620 refers to a neck region.
630 refers to an upper shoulder region.
640 refers to a bottle side region.
650 refers to a bottom region.
700 refers to an external thread.
710 refers to a plurality of thread channels.
800 refers to a bottle and cap system.
810 refers to a plurality of contact points.
820 refers to a plurality of vapor voids.

Figure 1:
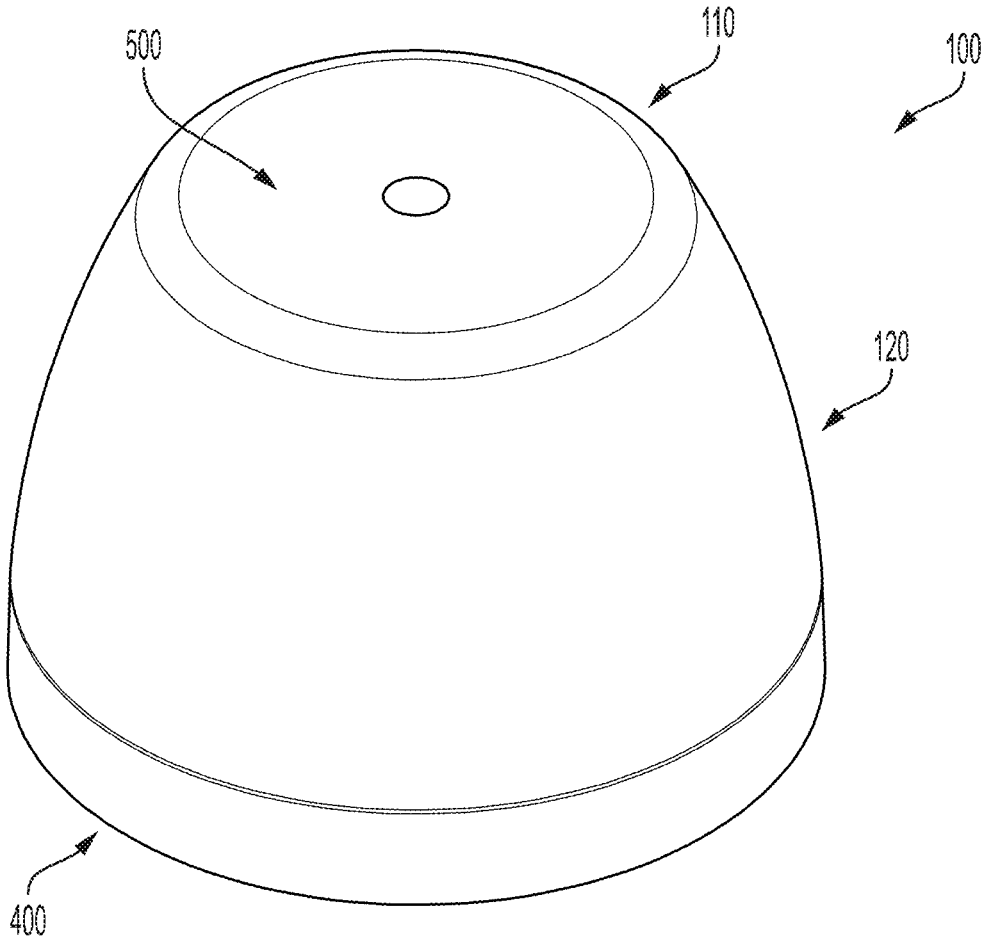
FIG. 1 illustrates a top perspective view of a cap.

FIG. 1 illustrates a top perspective view of a bottle cap (100) having a top region (110), a cap side region (120), and a cap open end (400).

Figure 6:
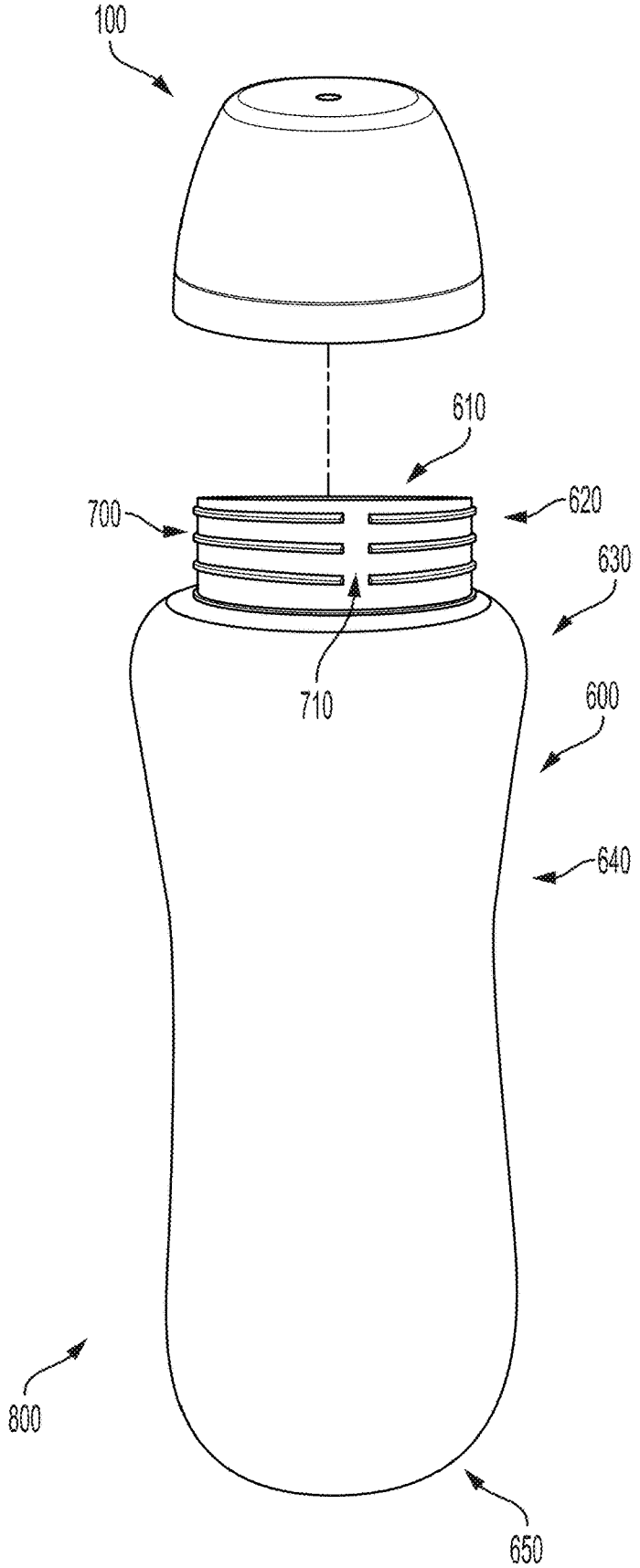
FIG. 6 illustrates a perspective view of a bottle and cap system.

In one embodiment of a bottle and cap system ((800) as seen in FIG. 6), as depicted in FIG. 1, the bottle cap comprises a cap closed end (500) which is substantially parallel with the cap open end (400). In this embodiment the bottle cap may be inverted and rested on the cap closed end so a user may dispense the solid contents of the bottle ((600) as seen in FIG. 6) into the bottle cap without a need to hold the bottle cap to prevent spilling the contents therein.

In other embodiments the top region may comprise either a concave or a convex shape relative to the cap side region.

Figure 2:
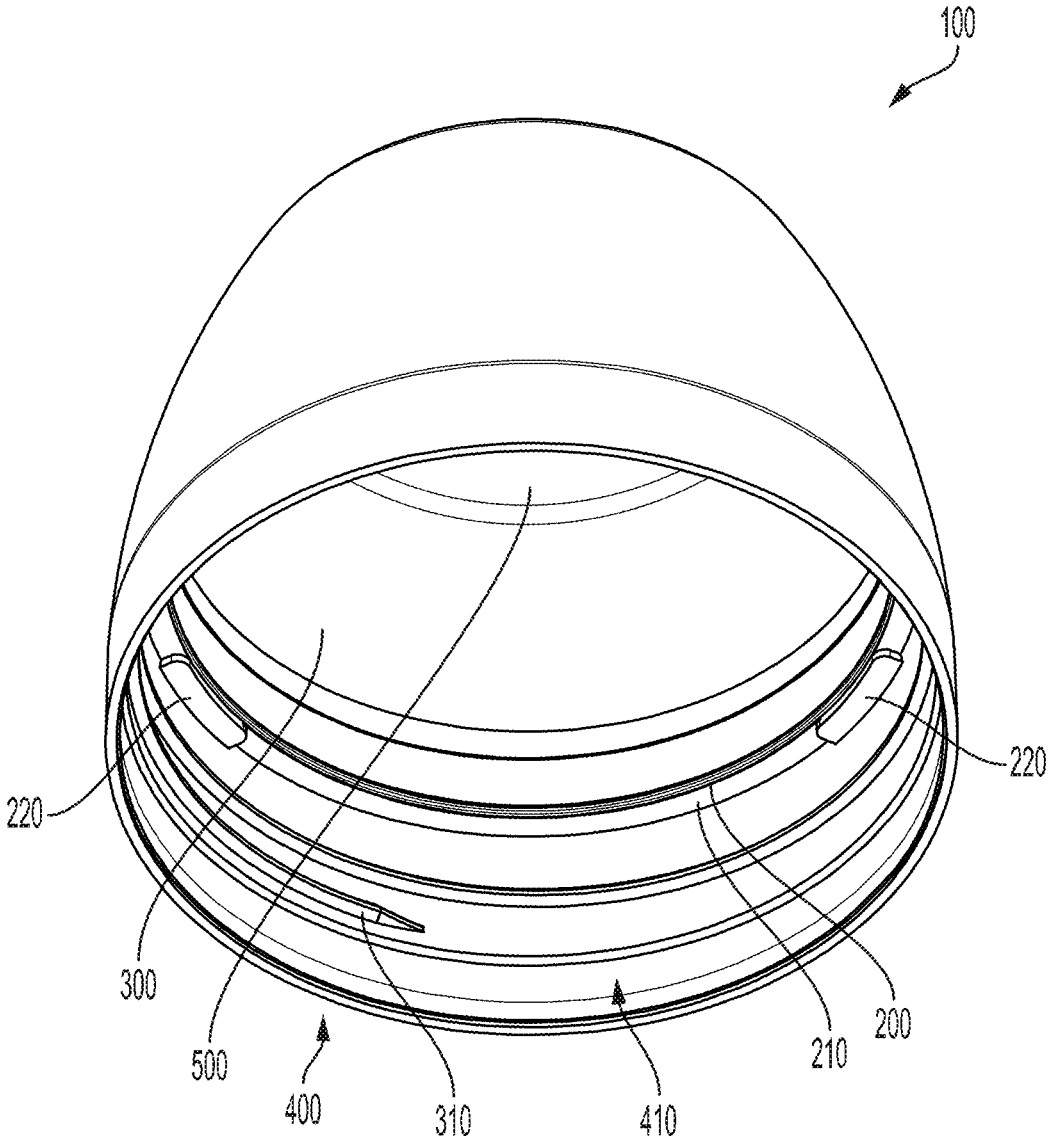
FIG. 2 illustrates a bottom perspective view of a cap.

FIG. 2 illustrates a bottom perspective view of a bottle cap (100) having a cap inner face (300) and a cap open end (400). The cap inner face comprises an inner lip (200) which comprises an inner lip face (210) and a plurality of lip extensions (220) which extend from the inner lip face toward the cap open end.

In one embodiment of a bottle and cap system ((800) as seen in FIG. 6), as depicted in FIG. 2, the cap inner face may comprise an internal thread (310) designed to threadably engage with the bottle ((600) as seen in FIG. 6), the internal thread making at least one revolution around the cap inner face. In other embodiments the cap inner face may comprise a plurality of tabs or lugs designed to threadably engage with an external thread ((700 as seen in FIG. 6). In still other embodiments the cap inner face may comprise a singular or plurality of protrusion(s), other than tabs or lugs, designed to threadably engage the external thread.

In another embodiment of a bottle and cap system ((800) as seen in FIG. 6), as depicted in FIG. 2, the inner lip (200) may be discontinuous along its circumference.

In one embodiment of a bottle and cap system, as depicted in FIG. 2, the cap inner face comprises a cap skirt (410) which is substantially perpendicular to a cap closed end (500).

Figure 3:
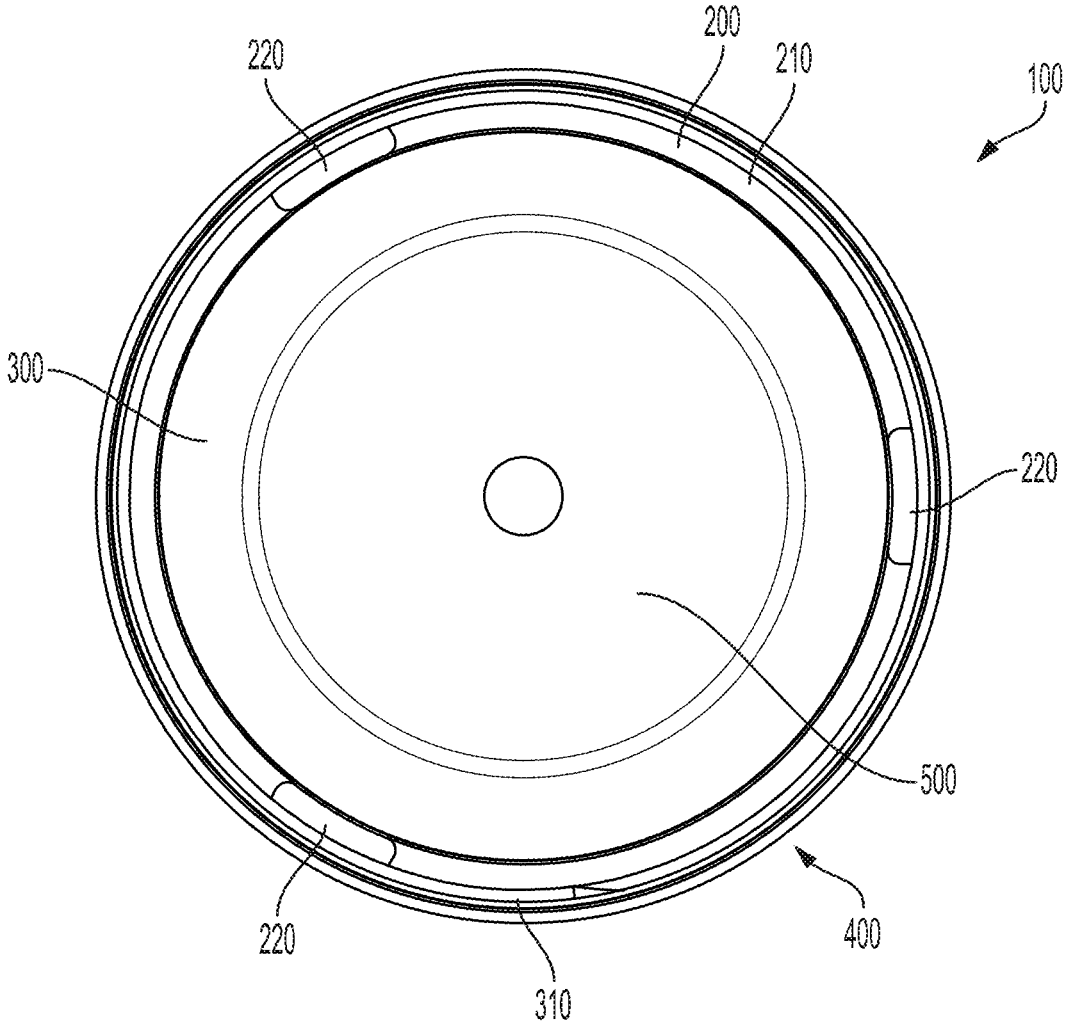
FIG. 3 illustrates bottom internal view of a cap.

FIG. 3 illustrates a bottom internal view of the bottle cap (100) illustrated in FIG. 2.

Figure 4:
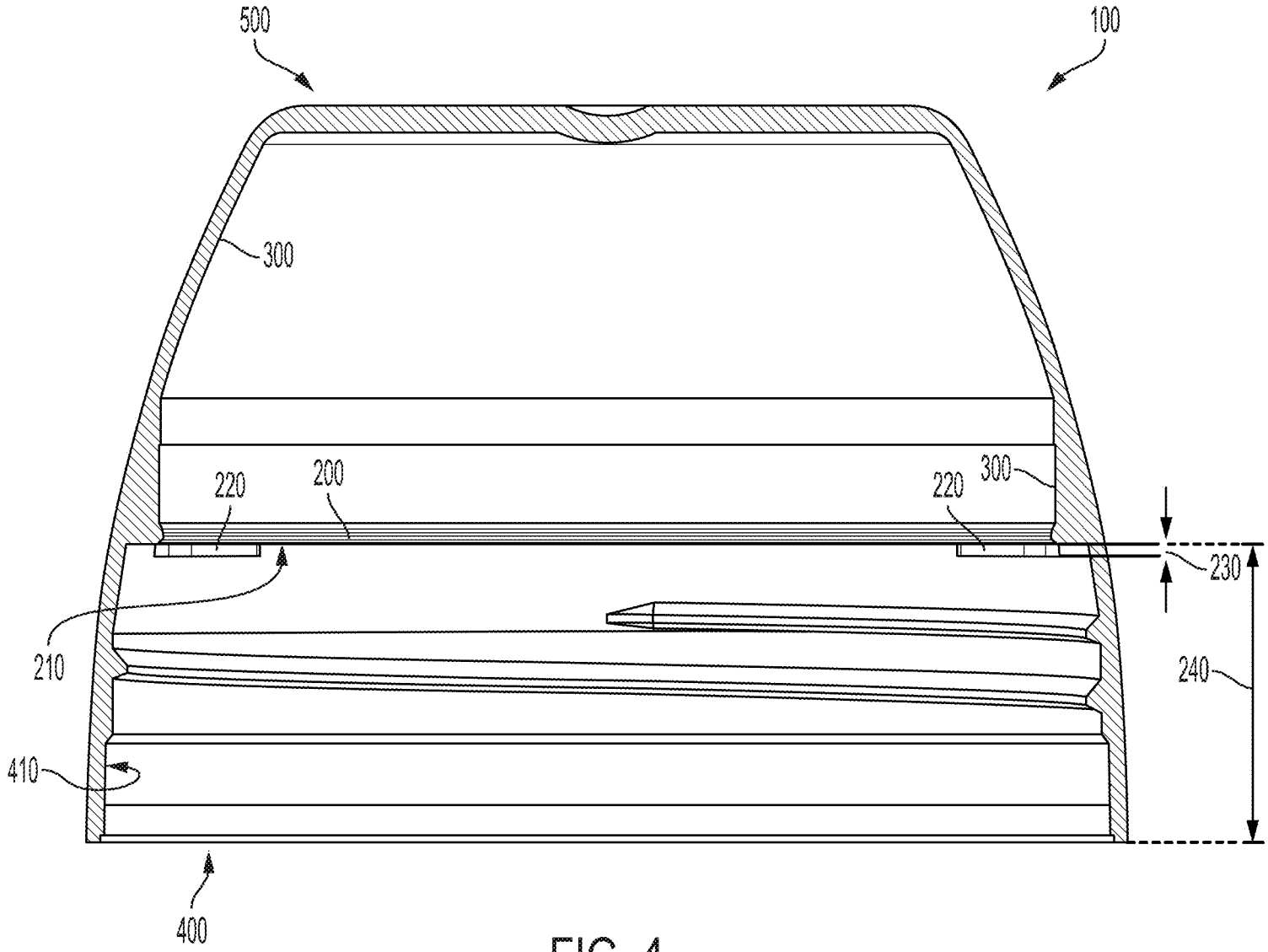
FIG. 4 illustrates a cutaway side view of a cap.

FIG. 4 illustrates a cutaway side view of a bottle cap (100) as illustrated in FIG. 1 and FIG. 2. the bottle cap comprises an inner lip (200) located inside the bottle cap and attached to the cap inner face (300) at a lip distance (240) from the cap open end (400). The inner lip comprises an inner lip face (210) which further comprises a plurality of lip extensions (220) which extend from the lip face toward the cap open end according to a lip extension thickness (230) which is greater than 1 mm. The inner lip is substantially parallel with the cap open end, and the inside diameter of the inner lip is less than the inner diameter of the cap inner face at a distance equal to the lip distance from the cap open end.

Figure 5:
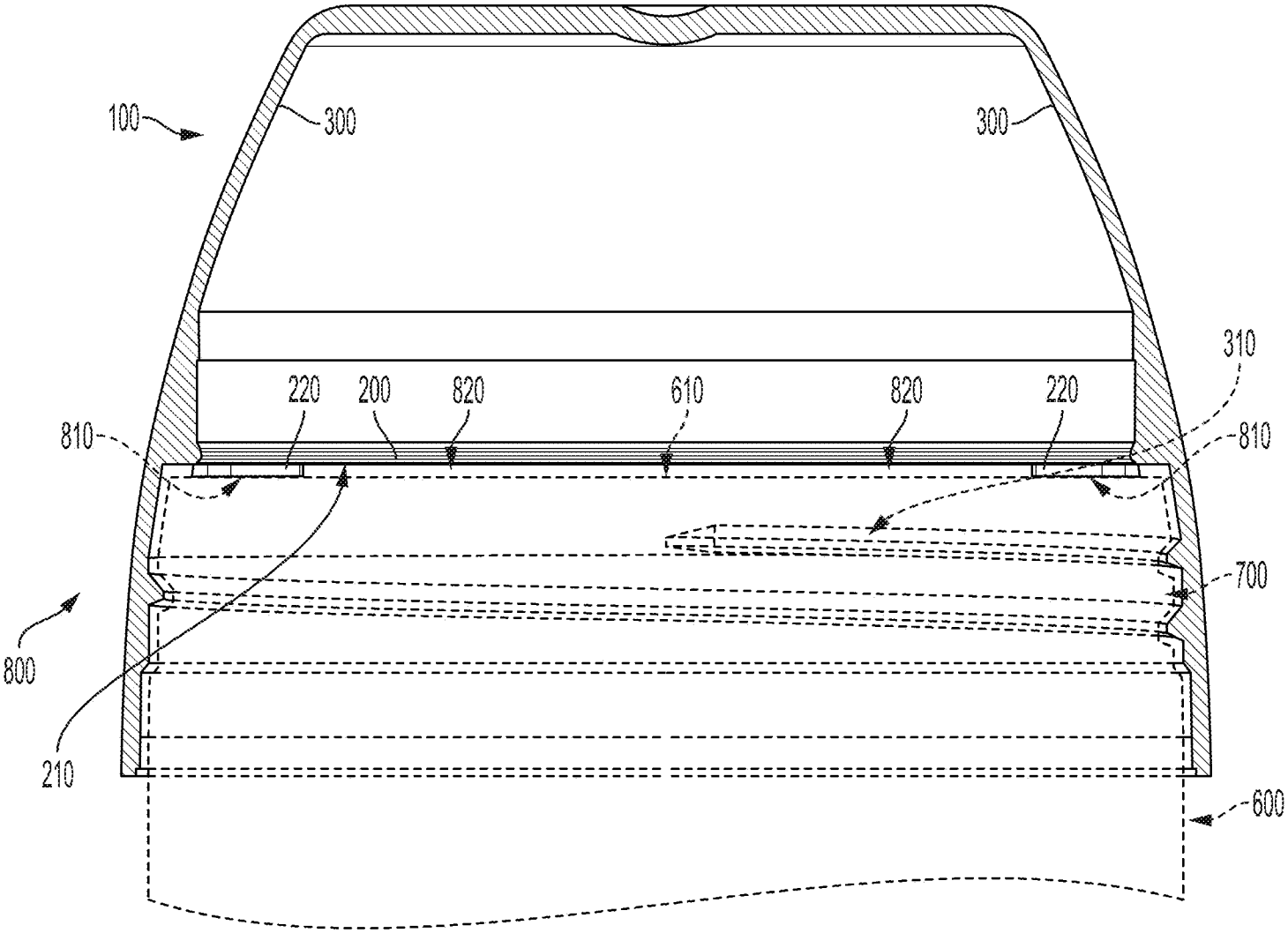
FIG. 5 illustrates a cutaway side view of a bottle and cap system.

FIG. 5 illustrates a bottle and cap system (800) comprising a bottle (600) and a bottle cap (100), where the bottle open end (610) contacts the plurality of lip extensions (220) at the plurality of contact points (810) when the external thread (700) is fully threadably engaged with a fastening mechanism located on the cap inner face (300). When the bottle cap open end is in contact with the plurality of lip extensions at the plurality of contact points, a plurality of vapor voids (820) are formed between the bottle open end and the inner lip (200).

In one embodiment of a bottle and cap system as depicted in FIG. 5 the fastening mechanism located on the cap inner face is an internal thread (310). In other embodiments the fastening mechanism located on the cap inner face may be comprised of a plurality of tabs or lugs, or other singular or plural protrusions designed to threadably engage with the external thread.

FIG. 6 illustrates a bottle and cap system (800) comprising a bottle cap (100) and a bottle (600). The bottle comprises a bottle open end (610), a neck region (620), an upper shoulder region (630), a bottle side region (640), and a bottom region (650). The neck region comprises an external thread (700) which further comprises a plurality of thread channels (710) which are oriented substantially vertically and substantially perpendicularly to the bottle open end.

In an exemplary embodiment of a bottle and cap system as depicted in FIG. 6 a user is able to dispense aroma from the bottle and cap system by squeezing the bottle in sufficient amounts to sufficiently detect the aroma and make an informed purchasing decision regarding the contents of the bottle accordingly, but dispensing aroma from the bottle in this manner will not cause the solid contents of the bottle to be dispensed or otherwise released. Specifically, by squeezing the bottle in this manner, a user causes aroma to pass through the plurality of vapor voids ((820) as shown in FIG. 5) and the plurality of thread channels.

Figure 7:
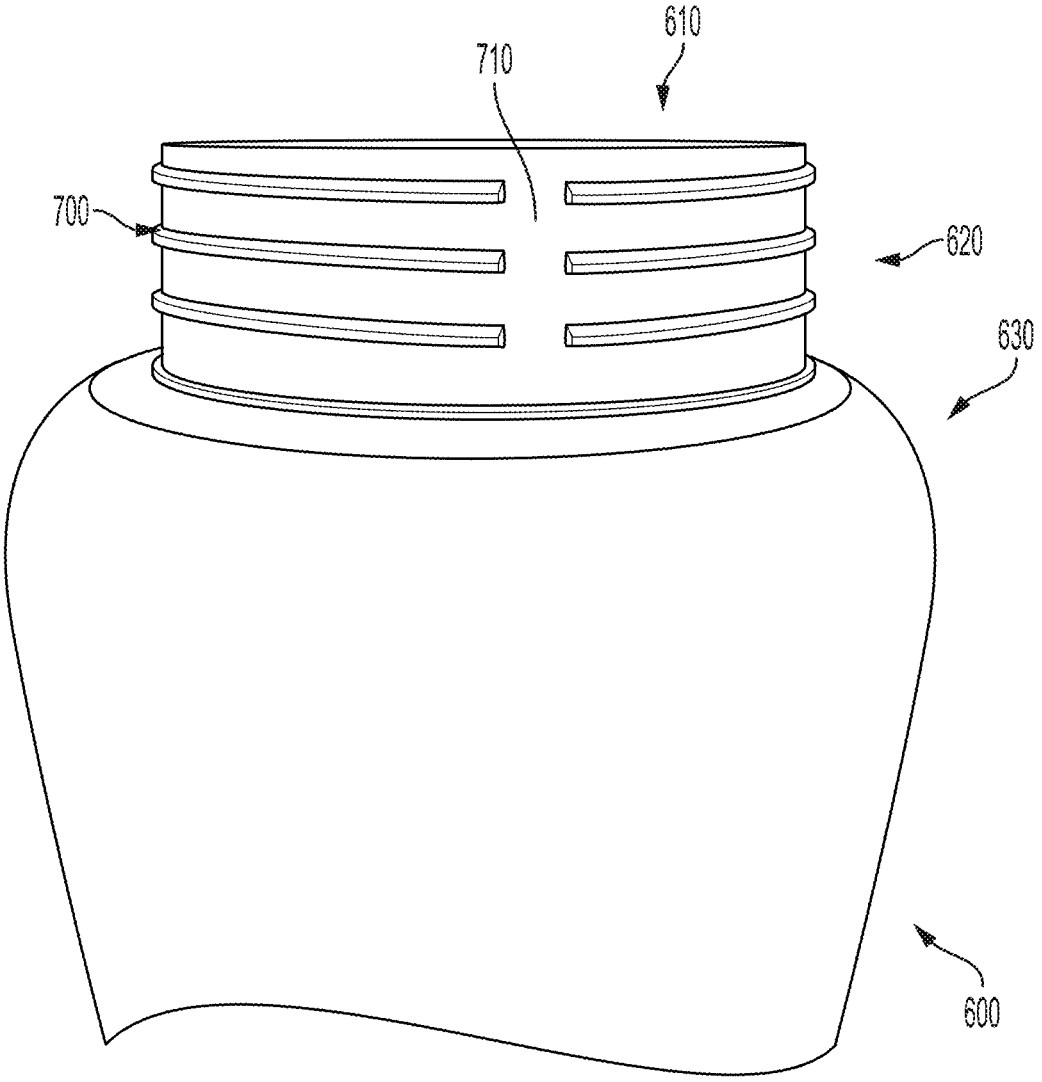
FIG. 7 illustrates a close up side perspective view of a bottle.

FIG. 7 illustrates a close up side perspective view of the bottle (600) illustrated in FIG. 6.

Figure 8:
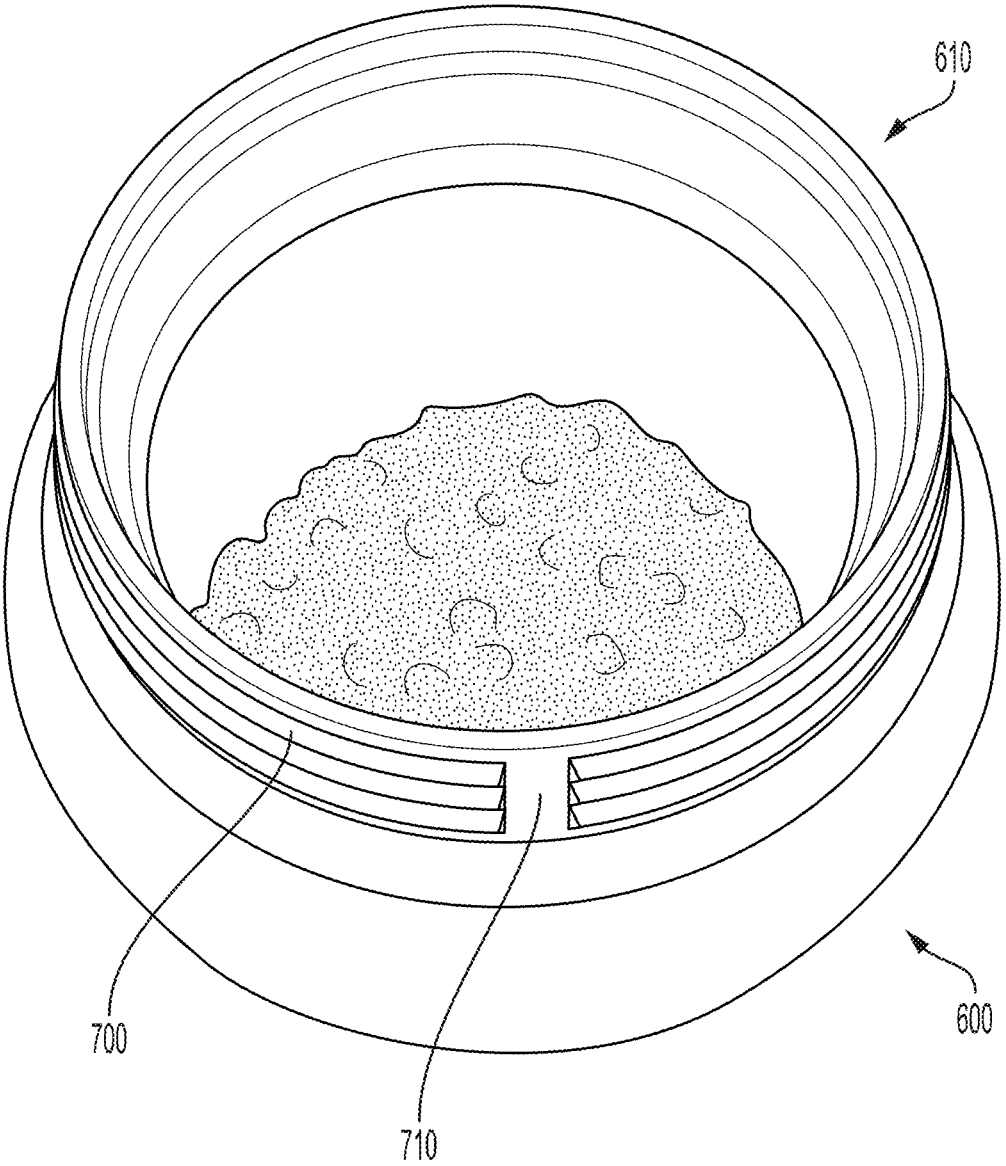
FIG. 8 illustrates a top perspective view of a bottle.

FIG. 8 illustrates a top perspective view of the bottle (600) illustrated in FIG. 6 and FIG. 7.

The bottle and cap system (800) comprising the bottle (600) and the bottle cap (100) disclosed herein may be manufactured using any number of different materials and any number of different manufacturing techniques in order to safely and effectively contain the contents of the bottle. In an exemplary embodiment the bottle and bottle cap will be manufactured of a plastic or plastics. Examples of plastics of which the bottle and cap system may be manufactured are polypropylene, polyethylene, polyethylene terephthalate, polyvinyl chloride, high-density polyethylene, low-density polyethylene, and acrylonitrile butadiene styrene. In other embodiments either the bottle, the bottle cap, or both are manufactured of cardboard or other paper, and it is further contemplated that edges of the component made thereof may be reinforced with a metal such as aluminum or steel. In yet other embodiments the bottle, the bottle cap, or both are made of a sheet metal such as aluminum or steel. Still other embodiments may comprise a bottle made of a glass, wherein the bottle cap is made of a flexible material which would allow a user to squeeze or otherwise deform the bottle cap in order to dispense sufficient aroma without dispensing the solid contents of the bottle. Manufacturing techniques may include injection molding, blow molding, pressing, bending, cutting and the like using common equipment for conducting such operations.

The embodiments of a bottle and cap system (800) disclosed herein represent an improvement over prior art bottle and cap systems, bottles, and caps. Specifically, the disclosed embodiments allow a user to dispense an amount of aroma sufficient to adequately detect the aroma according to the user's sense of and ability to smell. While dispensing the aroma the user does not discharge or otherwise release the solid contents of the bottle (600). The user can therefore make an informed purchasing decision regarding the aroma of the contents of the bottle, and dispense the solid contents of the bottle by disengaging the bottle cap (100) from the bottle. The user can thereafter re-engage the bottle cap with the bottle to safely and effectively maintain the solid contents within the bottle.

While the bottle and cap system has been described as having one or more exemplary designs, the present article may be further modified within the spirit and scope of this disclosure. This application is therefore intended to cover any variations, uses, or adaptations of the bottle and cap system using their general principles.

I claim:

1. A bottle and cap system (800) comprising:

a bottle cap (100) having an inner lip (200), a bottle (600) having a bottle open end (610) and an at least one external thread (700); said bottle and cap system further comprising:

wherein the inner lip further comprises a plurality of lip extensions (220);

wherein the at least one external thread further comprises a plurality of thread channels (710); and wherein the bottle cap threadably engages the at least one external thread such that the plurality of lip extensions contacts the bottle open end, at a plurality of contact points (810), when said bottle cap is fully threadably engaged with said at least one external thread, and wherein the inner lip does not contact the bottle open end, creating a plurality of vapor voids (820), when the bottle cap is fully threadably engaged with the at least one external thread.

2. The bottle and cap system of claim 1;

where the bottle and cap system is made of a plastic or plastics.

* * * * *